US011331524B1

(12) United States Patent
Epstein et al.

(10) Patent No.: US 11,331,524 B1
(45) Date of Patent: May 17, 2022

(54) FIRE SUPPRESSION SYSTEM FLUID ACCUMULATION AND TEMPERATURE MONITORING SYSTEM AND METHOD OF MAKING AND USING THE SAME

(71) Applicant: JTJ Tech LLC, Allentown, PA (US)

(72) Inventors: Jonathan Epstein, Allentown, PA (US); James N. Seip, Allentown, PA (US)

(73) Assignee: JTJ Tech LLC, Allentown, PA (US)

( * ) Notice: Subject to any disclaimer, the term of this patent is extended or adjusted under 35 U.S.C. 154(b) by 0 days.

(21) Appl. No.: 17/557,855

(22) Filed: Dec. 21, 2021

Related U.S. Application Data

(60) Provisional application No. 63/132,366, filed on Dec. 30, 2020.

(51) Int. Cl.
*A62C 37/50* (2006.01)
*A62C 35/68* (2006.01)
*A62C 35/62* (2006.01)

(52) U.S. Cl.
CPC ..... *A62C 37/50* (2013.01); *A62C 35/62* (2013.01); *A62C 35/68* (2013.01)

(58) Field of Classification Search
CPC ..... A62C 3/002; A62C 3/004; A62C 35/62; A62C 35/645; A62C 35/68; A62C 37/50
See application file for complete search history.

(56) References Cited

U.S. PATENT DOCUMENTS 2,487,933 A 11/1949 Martin
3,329,215 A * 7/1967 Kane ..... F16T 1/38 169/17
4,849,739 A 7/1989 Loiacono
5,749,391 A 5/1998 Loutzenhiser
5,950,150 A 9/1999 Lloyd et al.
6,102,066 A 8/2000 Craig et al.
6,443,173 B1 9/2002 Thompson, Jr.
6,540,028 B2 4/2003 Wood
7,766,031 B2 8/2010 Platusich et al.
8,443,908 B2 5/2013 McHugh, IV
10,540,622 B2 1/2020 McSheffrey
10,739,210 B2 8/2020 McCulloch et al.
10,850,145 B2 12/2020 Goyette et al.
2009/0020166 A1 1/2009 McHugh, IV
2010/0326676 A1 12/2010 Pecoraro et al.
2017/0100617 A1* 4/2017 Kochelek ..... A62C 37/50
2019/0224509 A1* 7/2019 Goyette ..... A62C 37/36

* cited by examiner

*Primary Examiner* — Darren W Gorman
(74) *Attorney, Agent, or Firm* — James R. McDaniel

(57) ABSTRACT

A sensor assembly for monitoring any fluid accumulation, temperature, and other properties, characteristics and conditions of the fluid in the dry portion of a life safety fire sprinkler system. The sensor assembly includes a sensor receptacle, an initial fluid level accumulation sensor, a fluid temperature sensor, and at least one upper fluid level accumulation sensor. The sensor assembly can transmit data in real time through a transmitter assembly to a controller and based upon programmed criteria and interact in real time, with other devices. For example, if the sensor assembly detects an amount of condensed fluid in the system and a temperature of the condensed fluid is below a programmed value (e.g., ≤38.0° F.), the system can send an alarm in real time that the system could be experiencing a potential fluid freezing event which could be detrimental to the sprinkler system.

20 Claims, 4 Drawing Sheets

FIRE SUPPRESSION SYSTEM FLUID ACCUMULATION AND TEMPERATURE MONITORING SYSTEM AND METHOD OF MAKING AND USING THE SAME

CROSS-REFERENCE TO RELATED APPLICATIONS

This application is a continuation-in-part of U.S. Patent Application 63/132,366, filed on Dec. 30, 2020, the disclosure of which is hereby incorporated by reference in its entirety to provide continuity of disclosure to the extent such a disclosure is not inconsistent with the disclosure herein.

FIELD OF THE INVENTION

The present invention pertains to the field of the monitoring and maintenance of fluid filled piping systems (e.g., fire sprinkler or domestic water systems, etc.) installed both residentially and commercially. The system further pertains to the fields of monitoring fluid accumulation, temperature, and other measurable characteristics within plumbing, sprinkler, and other piping systems for applications in residential and commercial real estate, among others. To accomplish these goals, the system utilizes a sensor assembly having a plurality of sensors located below the condensate drain (also known as a low point drain, auxiliary drain and drum drip) to monitor fluid accumulation and a temperature of the fluid collected below the drum drip in real time without interfering with or altering the fluid dynamics of the system.

BACKGROUND OF THE INVENTION

Fire sprinkler systems have been in use since the late 19th century. These systems play an integral role in protecting the lives of occupants in buildings and in reducing the damage to buildings from fire. To this end, sprinkler systems are regulated by applicable building codes. A structure's size, use, and occupancy expectations often mandate the installation of a sprinkler system.

It is well established that sprinkler systems are extremely effective life safety devices. However, the functionality of sprinkler systems can be compromised by cold weather, when pipes and sprinkler heads can freeze or burst, which can have fatal consequences by preventing the system from working properly.

Life safety fire sprinkler systems are designed to protect the lives of the occupants and contents inside structures and have been part of building code requirements for decades. There are many types of Auto-Extinguishing Systems (AES), the most common are wet fire sprinkler systems which are filled with pressurized water. When a sprinkler head is triggered, a volume water from the system is released at the head to deluge the threat.

Wet fire sprinkler systems are not ideal for locations where water-filled sprinkler pipes may be exposed to freezing conditions including, but not limited to, commercial freezers, parking garages and other uninhabited spaces. To protect areas such as these, dry fire sprinkler systems are utilized. These systems have both a pressurized water source and one or more sections filled with a pressurized fluid (air, nitrogen or similar gas).

The pressure in these areas is maintained through a device such as an air compressor and/or a jockey pump. A specialized valve separates the wet from the dry portions of the fire sprinkler system. The dry pipe valve and wet portion of the fire system are designed and installed in areas protected from freezing conditions. The portions of a dry fire system subject to freezing conditions is typically filled with pressurized air which is maintained by the air compressor and/or a jockey pump.

Due to fluctuating climate, temperature and pressure conditions within these spaces, the injection of compressed air can result in condensation within the dry piped system. Having no way to escape the closed dry pipe system, the condensation can accumulate. If that condensation is not removed, it creates a potential freeze hazard which could compromise the system and negatively impact its ability protect people and property.

As a result of this condensation accumulation, fire sprinkler codes and standard engineering practice require that the pipes of the dry portion of the system are pitched so that condensation will collect at drainage points located at low points in the system. Typically, these low points utilize a device known as a drum drip (also auxiliary drains or low-point drains) that allow for accumulation of water and drainage, as part of standard system maintenance procedure.

Drainage of condensation ensures that dry fire sprinkler systems will operate as designed and eliminate the potential for freezing of fluids and liquids. Early detection of an accumulation of condensation in freeze-prone locations within a dry fire sprinkler system is good maintenance practice to protect a structure and its occupants from compromise, including blockage, pipe burst and faulty discharge.

For example, a conventional drum drip assembly 2 is illustrated in FIG. 1. In particular, the drum drip assembly includes, in part, drum drip 4, upper isolation valve 6, lower condensate relief valve 8, and plug 10. During the operation of drum drip assembly 2, upper isolation valve 6 is conventionally opened to allow fluids and condensation from the pipes to collect in the drip drum 4. This is the "normal" operational and collecting state of the drum drip 4 (a.k.a., auxiliary drain, low point drain). It is to be understood that the upper isolation valve 6 is in the "open" position which allows any condensation to gravity feed into the drum drip 4. It is also to be understood that the lower condensate relief valve 8 is in the "closed" position so that any accumulation of condensation will then be contained between the top of the lower condensate relief valve 2 and into the drum drip 4 and may back up into the piped system if not routinely removed or drained.

In order to remove the collected condensate from the drum drip 4, the service technician closes the upper isolation valve 6 so that the system is not de-pressurized and opens the lower condensate relief valve 8. The service technician then conventionally removes the plug 10 so that any collected condensate contained in the drum drip 4 is drained away/removed from the drum drip 4.

In particular, during this "maintenance" or "draining" configuration of the drum drip 4, the upper isolation valve 6 is closed to isolate the drum drip 4 from the rest of the system. When the lower condensate relief valve 8 is opened, this allows the contents of the drum drip 4 to be discharged (via gravity and the built-up residual pressure). The lower condensate relief valve 8 must then be closed off, and the upper isolation valve 6 opened to allow any remaining or recently condensed fluid from above the upper isolation valve 6 to enter into the drum drip 4. Then, the lower condensate relief valve 8 is opened to release any final condensate in the drum drip 4 to be removed. Once the drum drip 4 is fully emptied of its liquid contents, the drum drip 4 is put back into the "collection" state with the lower condensate relief valve 8 being placed in the closed position and plug 10 installed and the upper isolation valve 6 being placed in the open position in order to prevent the system from being de-pressurized.

If significant amounts of fluid condensate are regularly present, an operator or service technician may conclude that further maintenance may need to be performed on the system to determine why amounts of fluid condensate are collected in this particular drum drip 4.

While this known drum drip assembly 2 is capable of allowing fluid condensate to be collected and drained from the drum drip 4, dry life safety sprinkler systems use pressurized fluid (air, nitrogen or similar gas) in areas that are not heated and are prone to freezing conditions. As discussed above, fluid such as water can accumulate in the dry portions of the systems from either component leaks or through condensation. If this accumulation of water is not removed, the system, or portions thereof, can freeze and burst. This system failure can negatively impact the safety of building occupants. Additionally, system failure can mean damage to the building and its contents.

Therefore, it is important to ensure that dry portions of a fire protection system are maintained and operated as designed. Preventing accumulations of fluid such as water will lower the risk of frozen sprinkler pipes and assure the safety of the building occupants. Consequently, it is desired to utilize a protection system that is designed to monitor and transmit information, in real time, based upon the conditions within these dry fire sprinkler systems to alert of early compromised conditions before system failure can occur.

Finally, no universal and practical method or product exists for installing sensors into pipes without altering or impacting the system's fluid dynamics. There remains a significant need for an economical and practical process to monitor the real-time properties, characteristics and conditions (temperature, water accumulation, pH, etc.) of the fluid within systems of pipes in diverse settings and environments.

Prior to the present invention, as set forth in general terms above and more specifically below, it is known to employ various types of monitoring and control process systems for fire sprinkler and other systems that utilize sensors. See for example, U.S. Pat. No. 2,487,933 by Martin, U.S. Pat. No. 4,849,739 by Loiacono, U.S. Pat. No. 5,749,391 by Loutzenhiser, U.S. Pat. No. 6,102,066 by Craig et al., U.S. Pat. No. 6,443,173 by Thompson, Jr., U.S. Pat. No. 6,540,028 by Wood, U.S. Pat. No. 7,766,031 by Platusich et al., U.S. Pat. No. 8,443,908 by McHugh, IV, U.S. Patent Application 2009/0020166 by McHugh, IV, and U.S. Patent Application 2010/0326676 by Pecoraro et al. While these various monitoring and control process systems for fire sprinkler and other systems that utilize sensors may have been generally satisfactory, there is nevertheless a need for a differentiated real-time monitoring and control process systems for fire sprinkler and other systems utilizing sensors which include sensors that measure the amount of water accumulation, temperature, and other measurable characteristics located within the piping system without altering the system's fluid dynamics or its functional design.

It is the purpose of this invention to fulfill these and other needs in the prior art in a manner more apparent to the skilled artisan once given the following disclosure.

The preferred monitoring and control process systems for fire sprinkler and other systems that utilize sensors, according to various embodiments of the present invention, offer the following advantages: ease of use; accuracy; durability; improved fluid temperature measurement; improved fluid accumulation measurement; ability to measure the temperature of the fluid/gas in real time without interrupting the flow of the fluid/gas; ease of attachment of the sensor to a new or existing fluid/gas piping system; ability to measure other characteristics of the fluid/gas in the piping system in real time; and ease or removal/replacement of the sensor assembly. In fact, in many of the preferred embodiments, these advantages are optimized to an extent that is considerably higher than heretofore achieved in prior, known monitoring and control process systems for fire sprinkler and other systems.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF INVENTION, EMBODIMENTS

Figure 1:
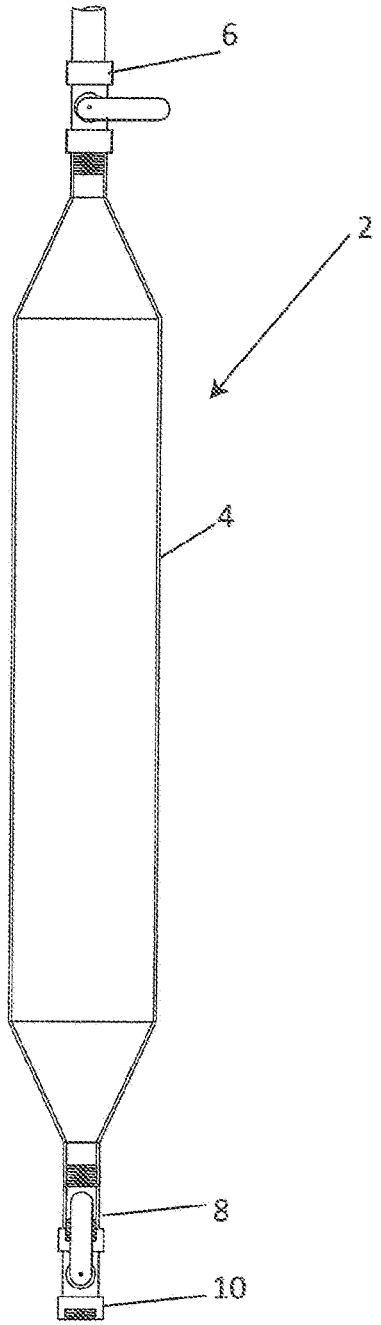
Figure 1 (Prior Art)
FIG. 1 is a schematic example of a known drum drip assembly in a piped system, according to the prior art.
Figure 2:
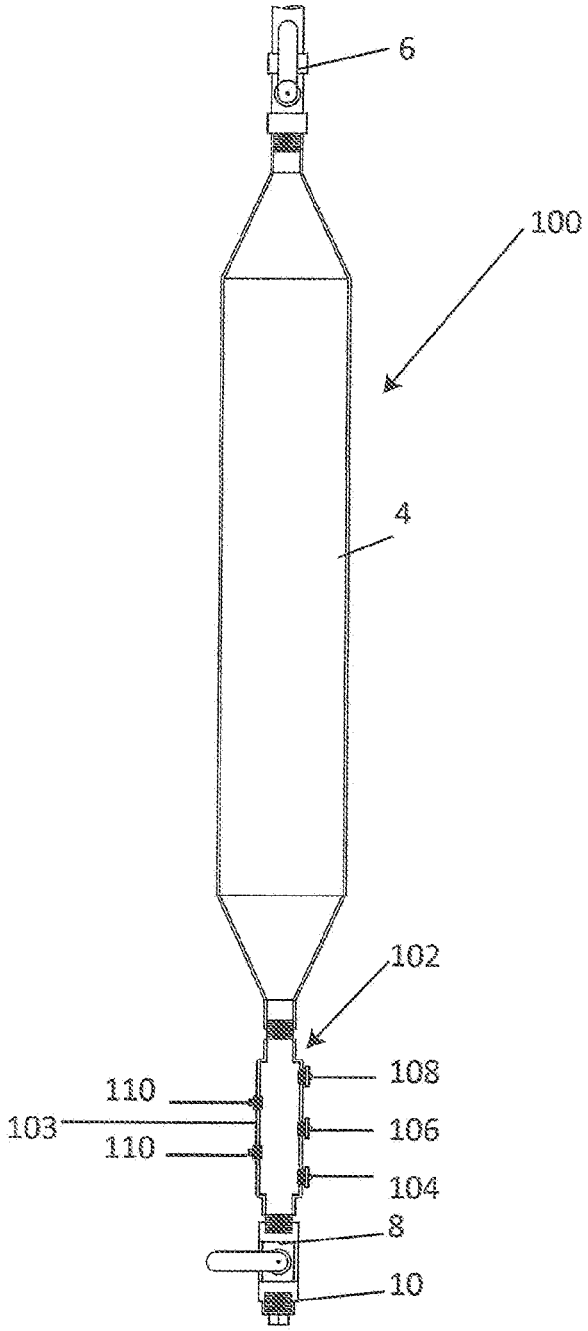
FIG. 2 is a schematic illustration of a water accumulation and temperature sensor receptacle assembly attached to a drum drip assembly, constructed according to the present invention.

In order to address the shortcomings of the prior known monitoring and control process systems for fire sprinkler and other systems that utilize sensors reference is now made to FIG. 2 where there is illustrated monitoring and control process system 100 for fire sprinkler and other systems that utilize sensors. Monitoring and control process system 100 includes, in part, drum drip 4, upper isolation valve 6, lower condensate relief valve 8, and water accumulation and temperature sensor receptacle assembly 102. It is to be understood that drum drip 4, upper isolation valve 6, and lower condensate relief valve 8 are constructed in a similar manner as described above.

Regarding water accumulation and temperature sensor receptacle assembly 102, water accumulation and temperature sensor receptacle assembly 102 includes, in part, sensor receptacle 103, initial fluid level accumulation sensor 104, temperature sensor 106, upper fluid level accumulation sensor 108, and an additional sensor(s) 110. It is to be understood that while five (5) sensors are shown, the number of sensors that can be attached to the sensor receptacle 103 can vary depending upon the characteristics of the fluid within the fire sprinkler and other systems that are desired to be measured. In particular, the number of openings in the sensor receptacle 103 can be conventionally modified to account for the number of sensors that are desired to be attached to the sensor receptacle 103. Preferably, the sensor receptacle 103 is constructed of any suitable, durable, rust resistant, UV resistant, high strength material.

A unique aspect of the present invention is that the monitoring and control process system 100 for fire sprinkler and other systems utilizes a sensor receptacle 103 with ports (or openings) for multiple sensors (104-110) designed to integrate at any point in a dry fire sprinkler system. Typically, the monitoring and control process system 100 for fire sprinkler and other systems is installed at low points in the system 100 to monitor and alert when specific internal conditions within the pipe system are detected, including, but not limited to:

1. The presence of condensation fluid(s) such as water via the fluid level sensor 104
2. The temperature of any condensed fluid(s) such as water via a temperature sensor 106.
3. It is to be understood that the presence of condensation fluid(s) and the temperature of any condensed fluid(s) may be measured by one (1) sensor.

A further unique aspect of the present invention is that the monitoring and control process system 100 for fire sprinkler and other systems can integrate into various points in a dry fire sprinkler system. Most commonly, but not exclusively, the monitoring and control process system 100 for fire sprinkler and other systems can be conventionally connected, preferably to the top of the lower condensate relief valve 8. As discussed above, it is to be understood that the sensor receptacle 103 can include two or more ports (or openings) designed to receive monitoring sensors (104-110) that can communicate over a hard-wired or wireless connection (transmitter assembly 150 in FIG. 3) to a controller 202 (FIG. 4) that can interpret the information from the sensors (104-110), as will be discussed in greater detail later.

In one embodiment of the monitoring and control process system 100 for fire sprinkler and other systems, the bottom sensor port would contain a sensor 104 that is designed to detect the presence of accumulated condensate such as accumulated water. As discussed above, it is important for owners of fire protection systems to know where, and when, their dry fire sprinkler systems contain an accumulation of condensate, as this could present a vulnerability to pipe freeze in certain environmental conditions.

In another embodiment of the monitoring and control process system 100 for fire sprinkler and other systems, the sensors (104-110) can communicate with a controller 202 or independently recognize and respond based upon real time data. Using the real time data transmitted from the sensors (104-110) through transmitter assembly 150 (FIG. 3), a processor 204 associated with the controller 202 can be programmed to respond appropriately.

In the following example, the monitoring and control process system 100 for fire sprinkler and other systems contains a fluid level sensor 104 in the lowest port of the sensor receptacle 103, a temperature sensor 106 in another port of the sensor receptacle 103, and a fluid level sensor in an upper port of the sensor receptacle 103. Examples of possible scenarios which can be monitored by the monitoring and control process system 100 for fire sprinkler and other systems are as follows:

Scenario 1: If a fluid level sensor 104 detects the presence of accumulated fluid condensation, AND if a temperature sensor 106 detects that the internal temperature of the fluid(s) within the sensor receptacle 103 is within a specified limit (e.g., ≤38.0° F.), there may be a threat of system compromise due to pipe freeze and the processor 204 would be programmed to transmit that data accordingly.

Scenario 2: If a fluid level sensor 104 detects the presence of accumulated fluid condensation, BUT if a temperature sensor 106 detects that the internal temperature of the fluid(s) within the sensor receptacle 103 is above a specified limit (e.g., >40.0° F.), there is no likely threat of system compromise due to pipe freeze and the processor 204 would be programmed to transmit that data accordingly.

Scenario 3: If a fluid level sensor 104 does not detect the presence of accumulated fluid condensation, AND if a temperature sensor 106 detects that the internal temperature of the fluid(s) within the sensor receptacle 103 is within a specified (e.g., ≤38.0° F.), there is no likely threat of system compromise due to pipe freeze and the processor 204 would be programmed to transmit that data accordingly.

Scenario 4: If a fluid level sensor 104 does not detect the presence of accumulated fluid condensation, AND if a temperature sensor 106 detects that the internal temperature of the fluid(s) within the system is above a specified limit (e.g., >40.0° F.), there is no likely threat of system compromise due to pipe freeze and the processor would be programmed to transmit that data accordingly.

Scenario 5: If a fluid level sensor 108 detects the presence of accumulated fluid condensation, AND if a temperature sensor 106 detects that the internal temperature of the fluid(s) within the sensor receptacle 103 is within a specified limit (e.g., ≤38.0° F.), there may be a threat of system compromise due to pipe freeze and the processor 204 would be programmed to transmit that data accordingly. In this scenario, due the relatively large amount of accumulated fluid condensation, the system may be experiencing a substantial fluid accumulation event and immediate service on the system is recommended.

Scenario 6: If a fluid level sensor 108 detects the presence of accumulated fluid condensation, BUT if a temperature sensor 106 detects that the internal temperature of the fluid(s) within the sensor receptacle 103 is above a specified limit (e.g., >40.0° F.), there is no likely threat of system compromise due to pipe freeze and the processor 204 would be programmed to transmit that data accordingly. However, again, due to the relatively large amount of accumulated fluid condensation, the system may be experiencing a substantial fluid accumulation event and service on the system is recommended.

Scenario 7: If a fluid level sensor 108 does not detect the presence of accumulated fluid condensation, AND if a temperature sensor 106 detects that the internal temperature of the fluid(s) within the sensor receptacle 103 is within a specified (e.g., ≤40.0° F.), there is no likely threat of system compromise due to pipe freeze and the processor 204 would be programmed to transmit that data accordingly. In this scenario, it is to be understood that as long as fluid level sensor 104 also does not detect the presence of accumulated condensation, then there is no likely threat of system compromise due to pipe freeze and the processor 204 would be programmed to transmit that data accordingly.

Scenario 8: If a fluid level sensor 108 does not detect the presence of accumulated fluid condensation, AND if a temperature sensor 106 detects that the internal temperature of the fluid(s) within the sensor receptacle 103 is above a specified limit (e.g. >40.0° F.), there is no likely threat of system compromise due to pipe freeze and the processor would be programmed to transmit that data accordingly. Again, in this scenario, it is to be understood that as long as fluid level sensor 104 also does not detect the presence of accumulated fluid condensation, then there is no likely threat of system compromise due to pipe freeze and the processor 204 would be programmed to transmit that data accordingly.

Construction of Monitoring and Control Process System

During the construction of the monitoring and control process system 100 for fire sprinkler and other systems, in order to accommodate monitoring and control process system 100 for fire sprinkler and other systems, a service technician would ensure that the isolation valve 6 is in the "open" position and that the lower condensate relief valve 8 is in the "closed" position which enables the attachment of the water accumulation and temperature sensor receptacle assembly 102 without de-pressuring the system.

The water accumulation and temperature sensor receptacle assembly 102 would be inserted between the isolation valve 6 and the lower condensate relief valve 8 using any necessary pipe couplings between the condensate relief valve 8 and the water accumulation and temperature sensor receptacle assembly 102. In the event that there is no isolation valve 6, then the temperature sensor receptacle assembly 102 would be inserted immediately before the lower condensate relief valve 8. It is to be understood that the water accumulation and temperature sensor receptacle assembly 102 can take the form of an assembly with two or more ports (or a fitting) to receive external sensors (104-110) to monitor and report the real-time conditions detected from within the system at this—and each—water accumulation and temperature sensor receptacle assembly 102. It is to be understood that any un-used ports or openings in the sensor receptacle 103 are plugged or otherwise covered so as to maintain pressure within the system.

Figure 3:
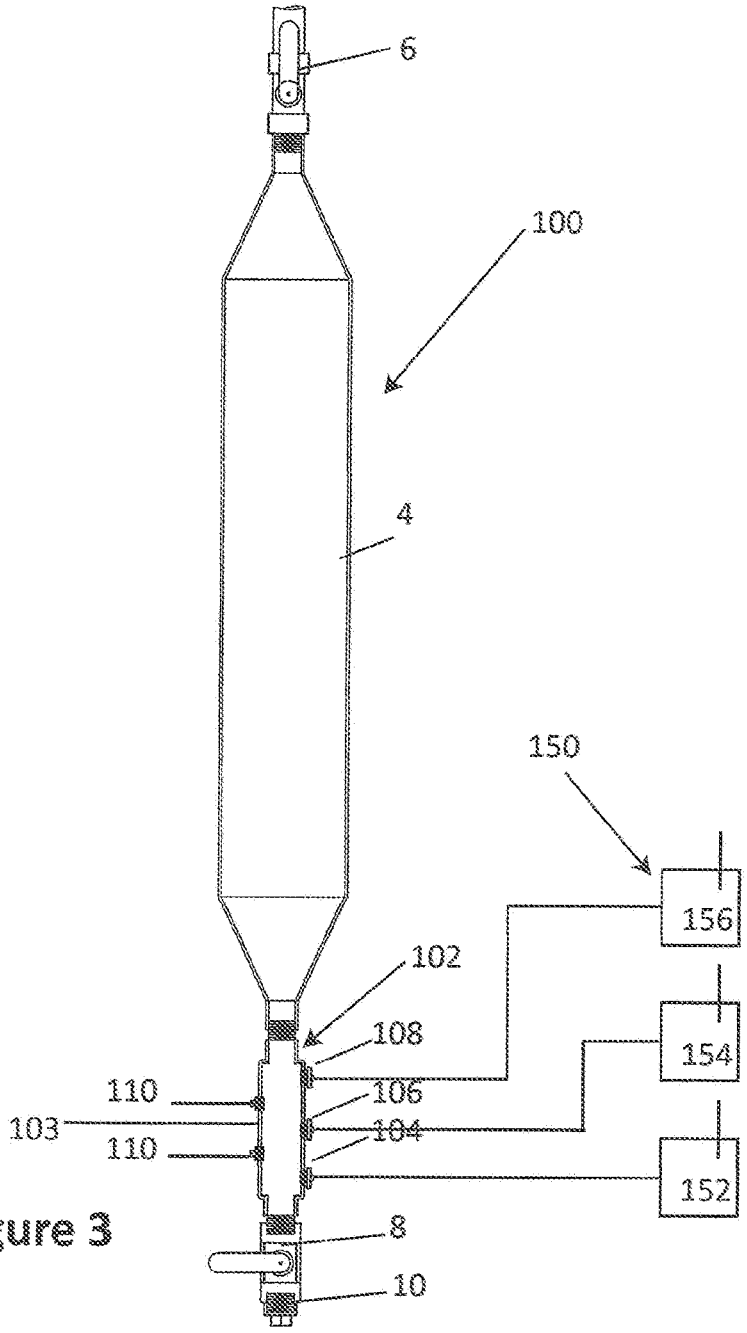
FIG. 3 is a schematic illustration of the water accumulation and temperature sensor receptacle assembly being attached to signal transmitters for transmitting information about fluid accumulation, temperature of the fluid, and other measurable characteristics collected from the sensors, constructed according to the present invention.

After the water accumulation and temperature sensor receptacle assembly 102 has been attached, the transmitter assembly 150 is operatively connected to the water accumulation and temperature sensor receptacle assembly 102. As shown in FIG. 3, transmitter assembly 150 includes, in part, a plurality of conventional electronic transmitter devices 152-156) such that one of the transmitters (152-156) are electrically connected to one of the sensors (104-110). In particular, transmitter device 152 is electronically connected to initial fluid level accumulation sensor 104. Transmitter device 154 is electronically connected to temperature sensor 106. Transmitter device 156 is electronically connected to upper fluid level accumulation sensor 108. Finally, it is to be understood that separate transmitter devices (not shown) can also be connected to the additional sensors 110.

Figure 4:
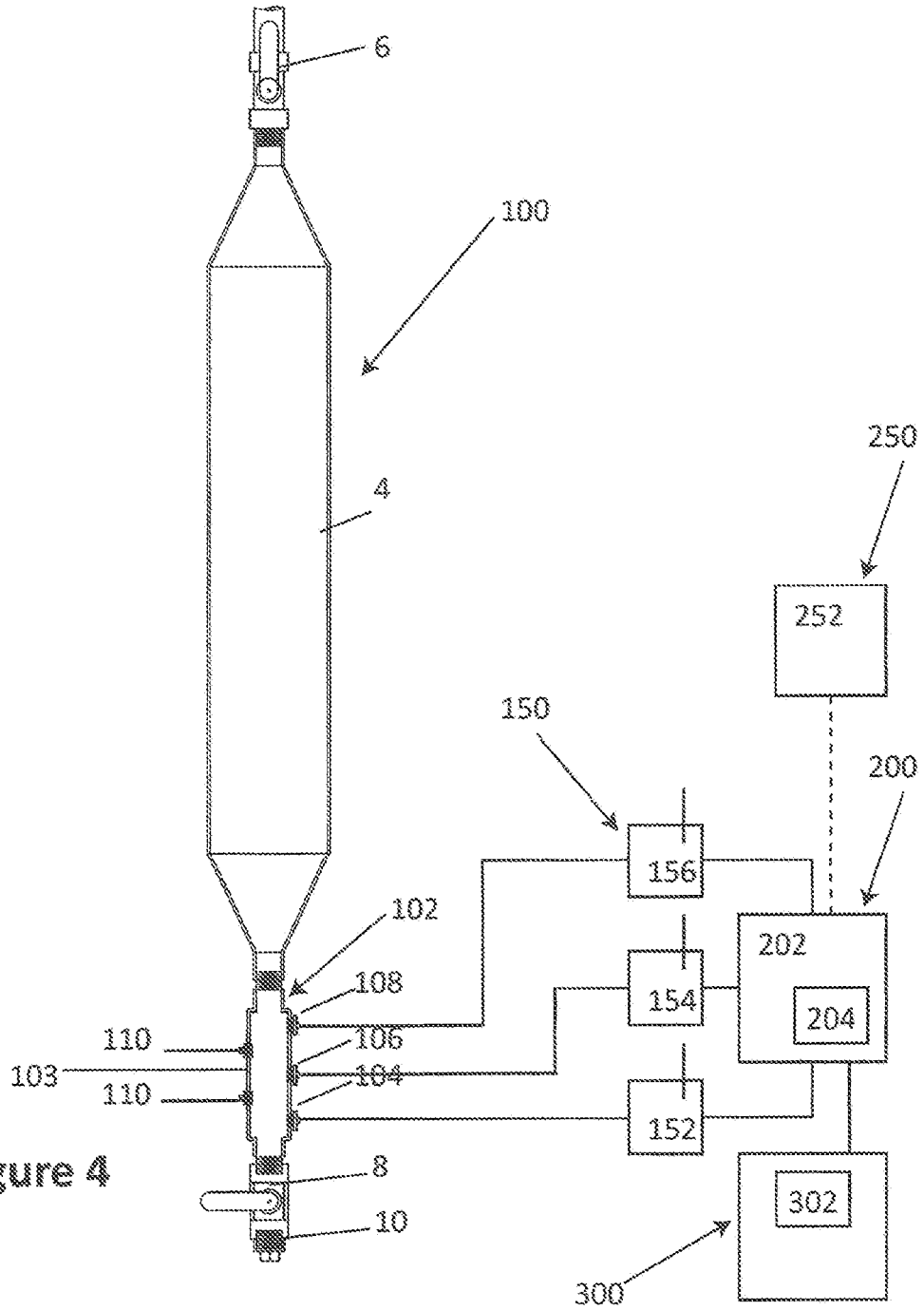
FIG. 4 is a schematic illustration of the signal transmitters being attached to a processor so that the transmitters can send the information about fluid accumulation, temperature of the fluid, and other measurable characteristics collected from the sensors to the processor and the processor can analyze the data collected from the sensors, constructed according to the present invention.

After the transmitter assembly 150 has been connected to water accumulation and temperature sensor receptacle assembly 102, as shown in FIG. 4, controller assembly 200 having a conventional on-site or off-site controller 202 and processor 204 are electronically connected to the transmitter assembly 150.

After the controller assembly 200 has been electronically connected to the transmitter assembly 150, the service technician then opens isolation valve 6 so that any fluid condensate in the system at that particular water accumulation and temperature sensor receptacle assembly 102 can start being monitored by the monitoring and control process system 100 for fire sprinkler and other systems.

It is to be understood that alarm assembly 250 which includes, in part, a conventional alarm 252 can also be electrically connected to the controller assembly 200. In this manner, the alarm assembly 250 can be used to provide a warning when certain fluid accumulation and/fluid temperature conditions are encountered. Furthermore, as discussed below, alarm 252 can be an audible alarm, a visual alarm, and/or a digital alarm. Also, the alarm 252 may take the form of an alert such as an e-mail, a text, or the like.

It is to be understood that a display module 300 which includes, in part, conventional display 302 can also be electrically connected to the controller assembly 200. In this manner, the controller 202 transmits in real time information related to the detected fluid accumulation and a temperature of the fluid located within a particular section of the piped system to the a display 302. The display module 300 can then be used to provide visual data and other information about the accumulated fluid and the temperature of the fluid in the system 100.

Operation of Monitoring and Control Process System

With respect to the operation of monitoring and control process system 100 for fire sprinkler and other systems, attention is directed to FIGS. 2-4. In particular, the isolation valve 6 is moved to the "on" or "open" position and the lower condensate relief valve 8 is moved to the "closed" or "off" position which enables the collection of any condensed fluid in the drum drip 4 and allows any collected, condensed fluid such as water to be collected in the water accumulation and temperature sensor receptacle assembly 102 without de-pressuring the system. In particular, any condensed fluid will be collected in the sensor receptacle 103.

The sensors (104-110) continuously detect the presence of any accumulated condensate in sensor receptacle 103 and the temperature of the accumulated condensate in sensor receptacle 103. Based upon the data from the sensors within the sensor receptacle 103, the controller 202 is programmed to respond to selected variables, as follows:

(I) In the event that either fluid level sensors 104 or 108 does not detect the presence of fluid such as water, the controller 202 (FIG. 4) reports that the dry system is dry, and that no further action is necessary.

(II) In the event that the fluid level sensor 104 or 108 detects the presence of fluid such as water, and the temperature sensor 106 detects that the temperature inside the sensor receptacle 103 is greater than the programmed temperature (e.g., 40° F.), the controller 202 will report that the dry system has an accumulation of fluid, but is not in jeopardy of pipe freeze. The controller 202 will initiate the low priority alarm/notification sequence(s) through alarm assembly 250 having alarm 252 (FIG. 4). As discussed below, alarm 252 can be an audible alarm, a visual alarm, and/or a digital alarm.

(III) In the event that the fluid level sensor 104 detects the presence of fluid, such as water or other condensate, and the temperature senor 106 detects that the temperature inside the sensor receptacle 103 is less than the programmed temperature (e.g., 38.0° F.), the controller 202 will report that the dry system has an accumulation of fluid and is in possible jeopardy of pipe freeze. The controller will initiate the high priority alarm/notification sequence(s) through alarm assembly 250 having alarm 252 (FIG. 4).

(IV) In the event that the fluid level sensors 104 and 108 both detect the presence of fluid such as water, and the temperature sensor 106 detects that the temperature inside the sensor receptacle 103 is less than the programmed temperature (e.g., 38.0° F.), the controller will report that the dry system has an accumulation of water and is in serious jeopardy of pipe freeze. The controller will initiate the highest priority alarm/notification sequence(s) through alarm assembly 250 having alarm 252 (FIG. 4).

In either event, the notification sequences can consist of one or more, or a combination thereof, of the following:

a. An audible alarm notification by making a sound
b. A visual alarm notification by blinking a light
c. A digital alarm transmitted from the controller 202 to another computer, monitoring center, or end user.
d. Activate a heat source to prevent onset of pipe freeze.

The data gathered in controller assembly 200 can be used to notify a monitoring company or building management personnel and/or property owner via the alert module 250 of fluid accumulation and/or low temperatures inside the sprinkler system. The collected data is also used to control warning indicators and alarm outputs and can be made available for real-time remote viewing and/or logging for archival purposes over an Internet connection.

The following are some other unique aspects of the present invention.

1. The monitoring and control process system 100 for fire sprinkler and other systems is designed to monitor, obtain and relay real-time data from within the sensor receptacle 103 and the system to assist in maintaining and operating a dry fire sprinkler system and to lower the risk of system failure.
2. The sensor receptacle 103 is constructed with multiple ports located along its vertical axis to accommodate two or more sensors (104-110) which can be installed interchangeably or as outlined above.
3. The sensors (104-110) in the sensor receptacle 103 obtain data from within the sensor receptacle 103 and the system, and may be, and without limitation to: temperature sensors; water detection sensors; pH sensors and other fluid property, characteristic and condition monitoring sensors such as oxidization, corrosion, etc.
4. The sensor receptacle 103 can be constructed with ports for the multiple sensors so that the ports are configured to obtain the appropriate readings as outlined above, or in any configuration thereof.
5. The location, number, and types of the sensors (104-110) are subject to modification based on site conditions and sound engineering practices.
6. The location, number and types of water accumulation and temperature sensor receptacle assemblies 102 are subject to modification based on site conditions and sound engineering practices.
7. The sensor receptacle 103 should be constructed from materials consistent with acceptable industry standards, including, but not limited to: brass, steel, iron, or other approved materials or composite materials.
8. The sensor receptacle 103 should be compliant with applicable industry and/or testing standards.
9. The sensor receptacle 103 can supplement, act as, or replace, the traditional auxiliary drum drip 4.
10. The sensor receptacle 103 can be designed to hold a designated volume of fluid.
11. The dimensions of water accumulation and temperature sensor receptacle assembly 102 can be adjusted to accommodate the various industry-standard pipe diameters. This allows the sensor receptacle 103 to be designed not only to fit the pipe, but to yield accurate measurements from the sensors (104-110).

Examples of Use of the Present Invention

The present invention is more fully described by way of the following non-limiting examples. Modifications of these examples will be apparent to those skilled in the art.

One example of the utility of the present invention includes the monitoring of condensed fluid such as water in fire sprinkler system pipes, especially in the context of residential and commercial construction and property management.

A further example of the utility of the present invention relates to what are referred to as dry pipe sprinkler systems. These are deployed in locations which serve areas particularly vulnerable to freezing conditions (e.g., commercial freezers and parking garages). These systems use an air lock to separate the water-filled portion of the system from the dry portion of the system. Unfortunately, air locks and air pressurization devices can also enable liquid to flow or condense into the dry portion of the fire sprinkler system allowing it to become compromised where it may freeze and disable the system and/or its ability to function properly without notification. Adding a water accumulation and temperature sensor receptacle assembly 102 in the dry pipe section of the system would serve as an early-warning indicator that the system has been compromised with fluid such as water in advance of a freeze event, potentially saving lives, property, time and money.

The present invention is also capable of providing measurements of the temperature, pH, fluid accumulation levels, or other properties of the fluid, relevant to plumbing, sprinkler, and other piping systems for applications in residential and commercial real estate.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. Furthermore, the term fluid/gas/liquid are meant to be used interchangeably.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein is a new and improved monitoring and control process system for fire sprinkler and other systems that utilizes sensors to monitor fluid accumulation and a temperature of the accumulated fluid. The preferred monitoring and control process systems for fire sprinkler and other systems that utilize sensors to monitor fluid accumulation and a temperature of the accumulated fluid, according to various embodiments of the present invention, offer the following advantages: ease of use; durability; improved fluid temperature measurement; improved fluid accumulation measurement; ability to measure the temperature of the fluid/gas in real time without interrupting the flow of the fluid/gas; ease of attachment of the sensor to a new or existing fluid/gas piping system; ability to measure other characteristics of the fluid/gas in the piping system in real time; and ease or removal/replacement of the sensor assembly.

In fact, in many of the preferred embodiments, these advantages of ease of use, durability, improved fluid temperature measurement, improved fluid accumulation measurement, ability to measure the temperature of the fluid/gas in real time without interrupting the flow of the fluid/gas, ease of attachment of the sensor to a new or existing fluid/gas piping system, ability to measure other characteristics of the fluid/gas in the piping system in real time, and ease or removal/replacement of the sensor assembly are optimized to an extent that is considerably higher than heretofore achieved in prior, known monitoring and control process systems for fire sprinkler and other systems.

We claim:

1. A system for monitoring fluid accumulation and temperature of a fluid in a dry portion of a fire sprinkler system comprising:

a sprinkler system being a piped system, wherein the sprinkler system comprises;

an upper isolation valve having a first end and a second end such that the first end of the upper isolation valve is operatively connected to the piped system, and a drum drip having a first end and a second end such that the first end of the drum drip is operatively connected to the second end of the upper isolation valve;

a fluid accumulation and temperature sensor receptacle assembly having a first end and a second end such that the first end of the fluid accumulation and temperature sensor receptacle assembly is operatively connected to the second end of the drum drip, wherein the fluid accumulation and temperature sensor receptacle assembly comprises;

a sensor receptacle having an upper end and a lower end, an initial fluid level accumulation sensor located adjacent to the lower end of the sensor receptacle, a fluid temperature sensor located adjacent to the initial fluid level accumulation sensor, and at least one upper fluid level accumulation sensor located adjacent to the fluid temperature sensor and adjacent to the upper end of the sensor receptacle;

a plurality of transmitters, wherein a first of the plurality of transmitters is operatively connected to the initial fluid level accumulation sensor, a second of the plurality of transmitters is operatively connected to the fluid temperature sensor, and a third of the plurality of transmitters is operatively connected to the at least one upper fluid level accumulation sensor in order to transmit data regarding a fluid accumulation and a fluid temperature within a particular section of the piped system; and a controller operatively connected to the plurality of transmitters for receiving the data regarding the fluid accumulation and the fluid temperature of the fluid accumulated within the particular section of the piped system.

2. The system for monitoring fluid accumulation and temperature of a fluid in a dry portion of a fire sprinkler system, according to claim 1, wherein the system is further comprised of:

a lower condensate relief valve having a first end and a second end such that the first end of the lower condensate relief valve is operatively connected to the second end of the fluid accumulation and temperature sensor receptacle assembly.

3. The system for monitoring fluid accumulation and temperature of a fluid in a dry portion of a fire sprinkler system, according to claim 2, wherein the system is further comprised of:

a plug operatively connected to the second end of the lower condensate relief valve.

4. The system for monitoring fluid accumulation and temperature of a fluid in a dry portion of a fire sprinkler system, according to claim 1, wherein the initial fluid level accumulation sensor monitors an accumulation of any condensed fluid at the lower end of the sensor receptacle;

the fluid temperature sensor monitors a temperature of the condensed fluid in the sensor receptacle; and the at least one upper fluid level accumulation sensor monitors an accumulation of the condensed fluid at the upper end of the sensor receptacle.

5. The system for monitoring fluid accumulation and temperature of a fluid in a dry portion of a fire sprinkler system, according to claim 4, wherein the fluid accumulation and temperature sensor receptacle assembly is further comprised of:

at least one other sensor located adjacent to the fluid temperature sensor providing measurements of other properties, characteristics and conditions of the condensed fluid, including at least one of pH, oxidization, and corrosion.

6. The system for monitoring fluid accumulation and temperature of a fluid in a dry portion of a fire sprinkler system, according to claim 1, wherein the system is further comprised of:

an alarm electrically connected to the controller.

7. The system for monitoring fluid accumulation and temperature of a fluid in a dry portion of a fire sprinkler system, according to claim 1, wherein the system is further comprised of:

a display system operatively connected to the controller, wherein the controller transmits in real time information related to the detected fluid accumulation and a temperature of the fluid located within the particular section of the piped system to the display system.

8. A method of constructing a system for monitoring fluid accumulation and temperature of a fluid in a dry portion of a fire sprinkler system comprising:

providing a sprinkler system being a piped system, wherein the sprinkler system comprises;

an upper isolation valve having a first end and a second end such that the first end of the upper isolation valve is operatively connected to the piped system, and a drum drip having a first end and a second end such that the first end of the drum drip is operatively connected to the second end of the upper isolation valve;

attaching, to the drum drip, a fluid accumulation and temperature sensor receptacle assembly having a first end and a second end such that the first end of the fluid accumulation and temperature sensor receptacle assembly is operatively connected to the second end of the drum drip, wherein the fluid accumulation and temperature sensor receptacle assembly comprises;

a sensor receptacle having an upper end and a lower end, an initial fluid level accumulation sensor located adjacent to the lower end of the sensor receptacle, a fluid temperature sensor located adjacent to the initial fluid level accumulation sensor, and at least one upper fluid level accumulation sensor located adjacent to the fluid temperature sensor and adjacent to the upper end of the sensor receptacle;

connecting, to the fluid accumulation and temperature sensor receptacle assembly, a plurality of transmitters, wherein a first of the plurality of transmitters is operatively connected to the initial fluid level accumulation sensor, a second of the plurality of transmitters is operatively connected to the fluid temperature sensor, and a third of the plurality of transmitters is operatively connected to the at least one upper fluid level accumulation sensor in order to transmit data regarding a fluid accumulation and a fluid temperature within a particular section of the piped system; and connecting, to the plurality of transmitters, a controller operatively connected to the plurality of transmitters for receiving the data regarding the fluid accumulation and the fluid temperature of the fluid accumulated within the particular section of the piped system.

9. The method of constructing a system for monitoring fluid accumulation and temperature of a fluid in a dry portion of a fire sprinkler system, according to claim 8, wherein the method is further comprised of:

attaching, to the fluid accumulation and temperature sensor receptacle assembly, a lower condensate relief valve having a first end and a second end such that the first end of the lower condensate relief valve is operatively connected to the second end of the fluid accumulation and temperature sensor receptacle assembly.

10. The method of constructing a system for monitoring fluid accumulation and temperature of a fluid in a dry portion of a fire sprinkler system, according to claim 9, wherein the method is further comprised of:

attaching, to the lower condensate relief valve, a plug operatively connected to the second end of the lower condensate relief valve.

11. The method of constructing a system for monitoring fluid accumulation and temperature of a fluid in a dry portion of a fire sprinkler system, according to claim 8, wherein the method is further comprised of:

monitoring by the initial fluid level accumulation sensor an accumulation of any condensed fluid at the lower end of the sensor receptacle;

monitoring by the fluid temperature sensor a temperature of the condensed fluid in the sensor receptacle; and monitoring by the at least one upper fluid level accumulation sensor an accumulation of the condensed fluid at the upper end of the sensor receptacle.

12. The method of constructing a system for monitoring fluid accumulation and temperature of a fluid in a dry portion of a fire sprinkler system, according to claim 11, wherein the method is further comprised of:

attaching at least one other sensor located adjacent to the fluid temperature sensor for monitoring other properties, characteristics and conditions of the condensed fluid, including at least one of pH, oxidization, and corrosion.

13. The method of constructing a system for monitoring fluid accumulation and temperature of a fluid in a dry portion of a fire sprinkler system, according to claim 8, wherein the method is further comprised of:

connecting an alarm assembly to the controller.

14. The method of constructing a system for monitoring fluid accumulation and temperature of a fluid in a dry portion of a fire sprinkler system, according to claim 8, wherein the method is further comprised of:

connecting a display system operatively to the controller, wherein the controller transmits real time information related to the detected fluid accumulation and a temperature of the fluid located within the particular section of the piped system to the display system.

15. A method of using a system for monitoring fluid accumulation and temperature of a fluid in a dry portion of a fire sprinkler system comprising:

providing a sprinkler system being a piped system, wherein the sprinkler system comprises;

an upper isolation valve having a first end and a second end such that the first end of the upper isolation valve is operatively connected to the piped system, and a drum drip having a first end and a second end such that the first end of the drum drip is operatively connected to the second end of the upper isolation valve;

providing a fluid accumulation and temperature sensor receptacle assembly having a first end and a second end such that the first end of the fluid accumulation and temperature sensor receptacle assembly is operatively connected to the second end of the drum drip, wherein the fluid accumulation and temperature sensor receptacle assembly comprises;

a sensor receptacle having an upper end and a lower end, an initial fluid level accumulation sensor located adjacent to the lower end of the sensor receptacle, a fluid temperature sensor located adjacent to the initial fluid level accumulation sensor, and at least one upper fluid level accumulation sensor located adjacent to the fluid temperature sensor and adjacent to the upper end of the sensor receptacle;

providing a plurality of transmitters, wherein a first of the plurality of transmitters is operatively connected to the initial fluid level accumulation sensor, a second of the plurality of transmitters is operatively connected to the fluid temperature sensor, and a third of the plurality of transmitters is operatively connected to the at least one upper fluid level accumulation sensor in order to transmit data regarding a fluid accumulation and a fluid temperature within a particular section of the piped system; and providing a controller operatively connected to the plurality of transmitters for receiving the data regarding the fluid accumulation and the fluid temperature of the fluid accumulated within the particular section of the piped system.

16. The method for using a system for monitoring fluid accumulation and temperature of a fluid in a dry portion of a fire sprinkler system, according to claim 15, wherein the method is further comprised of:

providing a lower condensate relief valve having a first end and a second end such that the first end of the lower condensate relief valve is operatively connected to the second end of the fluid accumulation and temperature sensor receptacle assembly.

17. The method for using a system for monitoring fluid accumulation and temperature of a fluid in a dry portion of a fire sprinkler system, according to claim 16, wherein the method is further comprised of:

providing a plug operatively connected to the second end of the lower condensate relief valve.

18. The method for using a system for monitoring fluid accumulation and temperature of a fluid in a dry portion of a fire sprinkler system, according to claim 15, wherein the method is further comprised of:

monitoring by the initial fluid level accumulation sensor an accumulation of any condensed fluid at the lower end of the sensor receptacle;

monitoring by the fluid temperature sensor a temperature of the condensed fluid in the sensor receptacle; and monitoring by the at least one upper fluid level accumulation sensor an accumulation of the condensed fluid at the upper end of the sensor receptacle.

19. The method for using a system for monitoring fluid accumulation and temperature of a fluid in a dry portion of a fire sprinkler system, according to claim 18, wherein the method is further comprised of:

providing at least one other sensor located adjacent to the fluid temperature sensor for monitoring other properties, characteristics and conditions of the condensed fluid, including at least one of pH, oxidization, and corrosion.

20. The method for using a system for monitoring fluid accumulation and temperature of a fluid in a dry portion of a fire sprinkler system, according to claim 15, wherein the method is further comprised of:

providing an alarm assembly, wherein the alarm assembly is operatively connected to the controller.

* * * * *